US005689111A

United States Patent [19]

Dresch et al.

[11] Patent Number: 5,689,111

[45] Date of Patent: Nov. 18, 1997

[54] ION STORAGE TIME-OF-FLIGHT MASS SPECTROMETER

[75] Inventors: Thomas Dresch, Berlin, Germany; Erol E. Gulcicek, Cheshire; Craig Whitehouse, Branford, both of Conn.

[73] Assignee: Analytica of Branford, Inc., Branford, Conn.

[21] Appl. No.: 689,459

[22] Filed: Aug. 9, 1996

Related U.S. Application Data

[60] Provisional application No. 60/002,118, Aug. 10, 1995 and Provisional application No. 60/002,122, Aug. 10, 1995.

[51] Int. Cl. [6] ..... H01J 49/40

[52] U.S. Cl. ..... 250/287

[58] Field of Search ..... 250/287, 281, 250/282, 290, 292, 286

[56] References Cited

U.S. PATENT DOCUMENTS

| | | | |
|---|---|---|---|
| 2,685,035 | 7/1954 | Wiley | 250/287 |
| 2,957,985 | 10/1960 | Brubaker | 250/287 |
| 3,576,992 | 5/1971 | Moorman | 250/287 |
| 5,117,107 | 5/1992 | Guilhaus et al. | 250/287 |
| 5,179,287 | 1/1993 | Douglas | 250/290 |

*Primary Examiner*—Kiet T. Nguyen

*Attorney, Agent, or Firm*—Levisohn, Lerner, Berger & Langsam

[57] ABSTRACT

A method and an apparatus which combines a linear two dimensional ion guide or a two dimensional ion storage device in tandem with a time-of-flight mass analyzer to analyze ionic chemical species generated by an ion source. The method improves the duty cycle, and therefore, the overall instrument sensitivity with respect to the analyzed chemical species.

10 Claims, 9 Drawing Sheets

ION STORAGE TIME-OF-FLIGHT MASS SPECTROMETER

RELATED APPLICATIONS

This application claims the benefit of U.S. Provisional application Ser. No. 60/002,118 and U.S. Provisional application Ser. No. 60/002,122, both filed Aug. 10, 1995.

FIELD OF THE INVENTION

This invention relates in general to mass spectrometers and in particular to the use of time-of-flight (TOF) mass spectrometers in combination with two dimensional ion traps that are also used as ion guides and ion transport lenses.

BACKGROUND OF THE INVENTION

In a time-of-flight mass spectrometer, ions are accelerated by electric fields out of an extraction region into a field free flight tube which is terminated by an ion detector. By applying a pulsed electric field or by momentary ionization in constant electric fields, a group of ions or packet starts to move at the same instant in time, which is the start time for the measurement of the flight time distribution of the ions. The flight time through the apparatus is related to the mass to charge ratios of the ions. Therefore, the measurement of the flight time is equivalent to a determination of the ion's m/z value. (See, e.g., the Wiley and McLaren; and, the Laiko and Dodonov references cited below).

Only those ions present in the extraction zone of the ion accelerator, (also referred to as "the pulser"), in the instant when the starting pulse is applied are sent towards the detector and can be used for analysis. In fact, special care must be taken not to allow any ions to enter the drift section at any other time, as those ions would degrade the measurement of the initial ion package.

For this reason, the coupling of a continuously operating ion source to a time-of-flight mass spectrometer suffers from the inefficient use of the ions created in the ion source for the actual analysis in the mass spectrometer. High repetition rates of the flight time measurements and the extraction of ions from a large volume can improve the situation, but the effective duty cycles achieved varies as a function of mass and can be less then 10% at low mass.

If extremely high sensitivity of the mass analysis is required or if the number of ions created in the ion source is relatively small, there is need to make use of all the ions available. This requires some sort of ion storage in-between the analysis cycles. Time-of-flight instruments that use dc plate electrode configurations or quadrupole ion traps for ion storage have been built and operated successfully. (See e.g., the Grix, Boyle, Mordehai, and Chien references cited below). While the storage efficiency of de configurations is limited, with quadrupole ion traps a compromise between efficient collisional trapping and collision free ion extraction has to be found.

In the present invention, a multiple pumping stage linear two dimensional multipole ion guide is configured in combination with a time-of-flight mass spectrometer with any type of ionization source to increase duty cycle and thus sensitivity and provide the capability to do mass selection. Previous systems, such as the ion trap/time-of-flight system of Lubman (cited below), have combined a storage system with time-of-flight, however, these systems' trapping time are long, on the order of a second, thus not taking full advantage of the speed at which spectra can be acquired and thereby limiting the intensity of the incoming ion beam. In addition, the ion trap is strictly used as the acceleration region and storage region. Also, 100% duty cycle is not possible with the ion trap TOF system due to the fact that the ion trap can not be filled and empty at the same time; in addition, there are currently electronic limitations (See e.g., Mordehai, cited below), whereas in this embodiment it is one of the possible modes of operation.

The use of a two dimensional multipole ion guide to store ions prior to mass analysis has been implemented by Dolnikowski et al. on a triple quadrupole mass spectrometer. This combination, in fact, has become routine analysis technique for triple quadrupoles. A more recent combination was made by Douglas (U.S. Pat. No. 5,179,278) who combined a two dimensional multipole ion guide with a quadrupole ion trap mass spectrometer. Both of these systems are quite different from the current embodiment. In both of the above systems, the residence times of the ions in the linear two dimensional quadrupole ion guide were over 1–3 seconds, whereas, in the current embodiment the ions can be stored and pulsed out of the linear two dimensional multipole ion guide at a rate of more than 10,000/sec, thus utilizing much faster repetition rates. Due to the inherent fast mass spectral analysis feature of the time-of-flight mass analyzers, continuously generated incoming ions are analyzed at a much better overall transmission efficiency than the dispersive spectrometers such as quadrupoles, ion traps, sectors or Fourier Transform mass analyzers. When an ion storage device is coupled in front of a dispersive mass analyzer instrument, the overall transmission efficiency of an instrument, no doubt, increases; however, since the ion fill rate into the storage device is much faster than the full spectral mass analysis rate, the overall transmission efficiencies are limited by the mass spectral scan rates of the dispersive instruments which are at best on the order of seconds. Time-of-flight mass analyzers, on the other hand, can take full use of the fast fill rates of the incoming continuous stream of ions since the mass spectral scan rates of 10,000 per second and more can well exceed these fill rates into a storage device.

Also unique to this embodiment is the fact that the ion packet pulse out of the linear two dimensional multipole ion guide forms a low resolution time of flight separation of the different m/z ions into the pulser where the timing is critical between when the pulse of ions are released from the linear two dimensional multipole ion guide and the time at which the pulser is activated. This is to say that the linear two dimensional multipole ion guide pulse time and the delay time to raise the pulser can be controlled to achieve 100% duty cycle on any ion in the mass range or likewise a 0% duty cycle on any ion in the mass range or any duty cycle in between. Also, as pointed out by Douglas (U.S. Pat. No. 5,179,278), an ion guide can hold many more ions than what the ion trap mass analyzer can use. This decreases the duty cycle of the system if all trapped ions are to be mass analyzed. In contrast, that is not an issue in the current embodiment.

As the linear two dimensional multipole ion guide trap is filled with more ions, the space charging effects or coulombic interactions between the ions increase resulting in two major consequences. First, the mass spectral characteristics may change due to overfilling of the storage device where more fragmentation will occur due to strong ionic interactions. Second, the internal energy of the ions will increase, making it harder to control and stop the ions going into a mass analyzer device. The above problems can again be overcome using a time-of-flight mass analyzer at fast scan rates which will not allow excessive charge build up in the storage ion guide. Operating at very fast acquisition rates, time-of-flight instrument does require intricate timing of the trapping and the pulsing components.

BRIEF DESCRIPTION OF THE INVENTION

It is the principal object of this invention to provide means for increasing the detection limits of a continuous stream of ionic chemical species generated eternally in a time-of-flight mass spectrometer.

It is a further object of this invention to provide means for increasing the detection limits of said time-of-flight instrument by increasing the duty cycle of the mass analysis.

In accordance with the above objects, a two dimensional ion guide device with accompanying ion optics and power supplies, switching circuitry, and timing device for said switching circuitry is provided to increase the ion throughput into the time-of-flight mass analyzer.

These and further objects, features, and advantages of the present invention will become apparent from the following description, along with the accompanying figures and drawings.

DETAILED DESCRIPTION OF THE PREFERRED EMBODIMENTS

Figure 1:
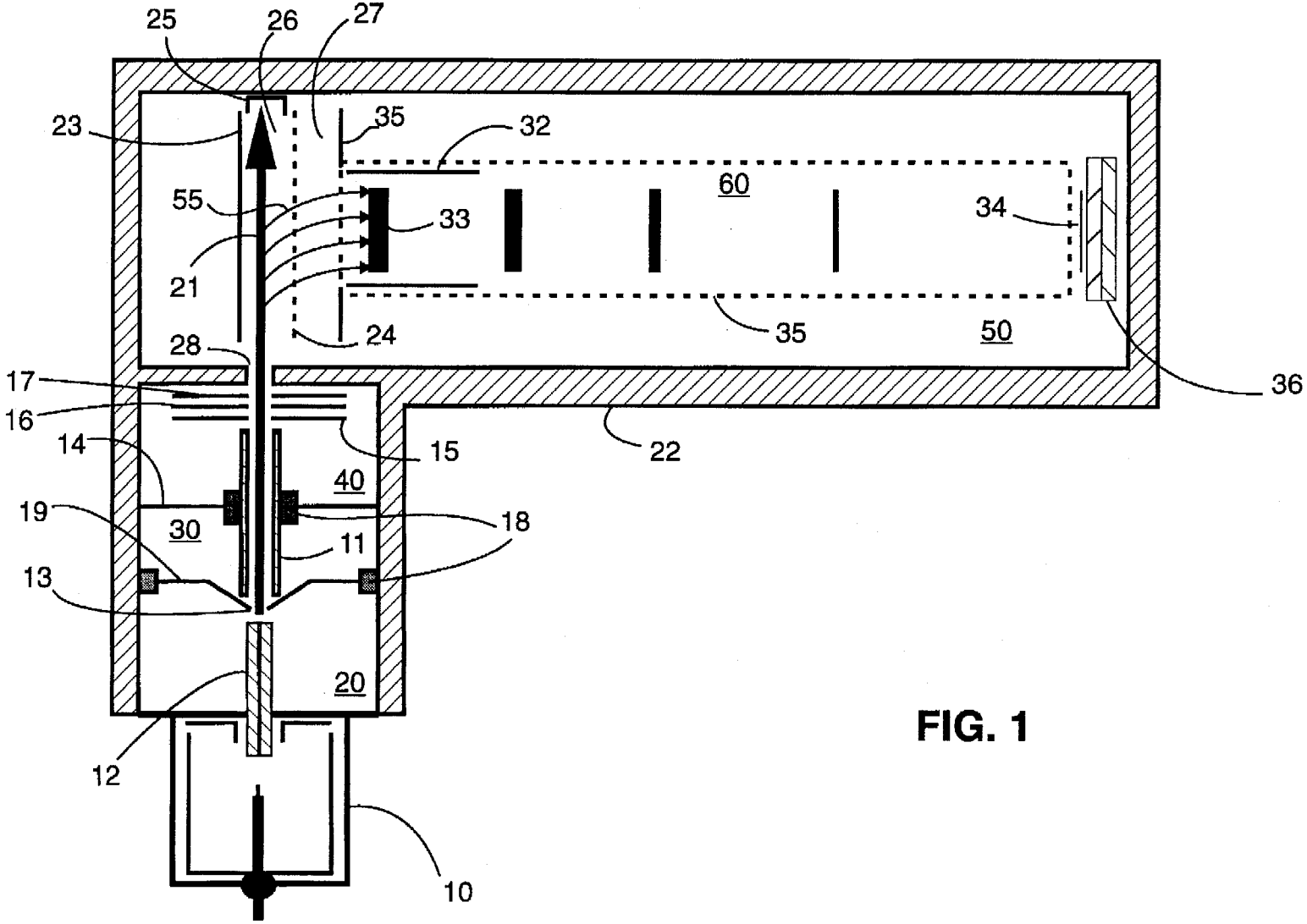
FIG. 1 is a schematic representation of a simple linear time-of-flight mass analyzer utilizing orthogonal acceleration with an atmospheric pressure ionization source.
Figure 2:
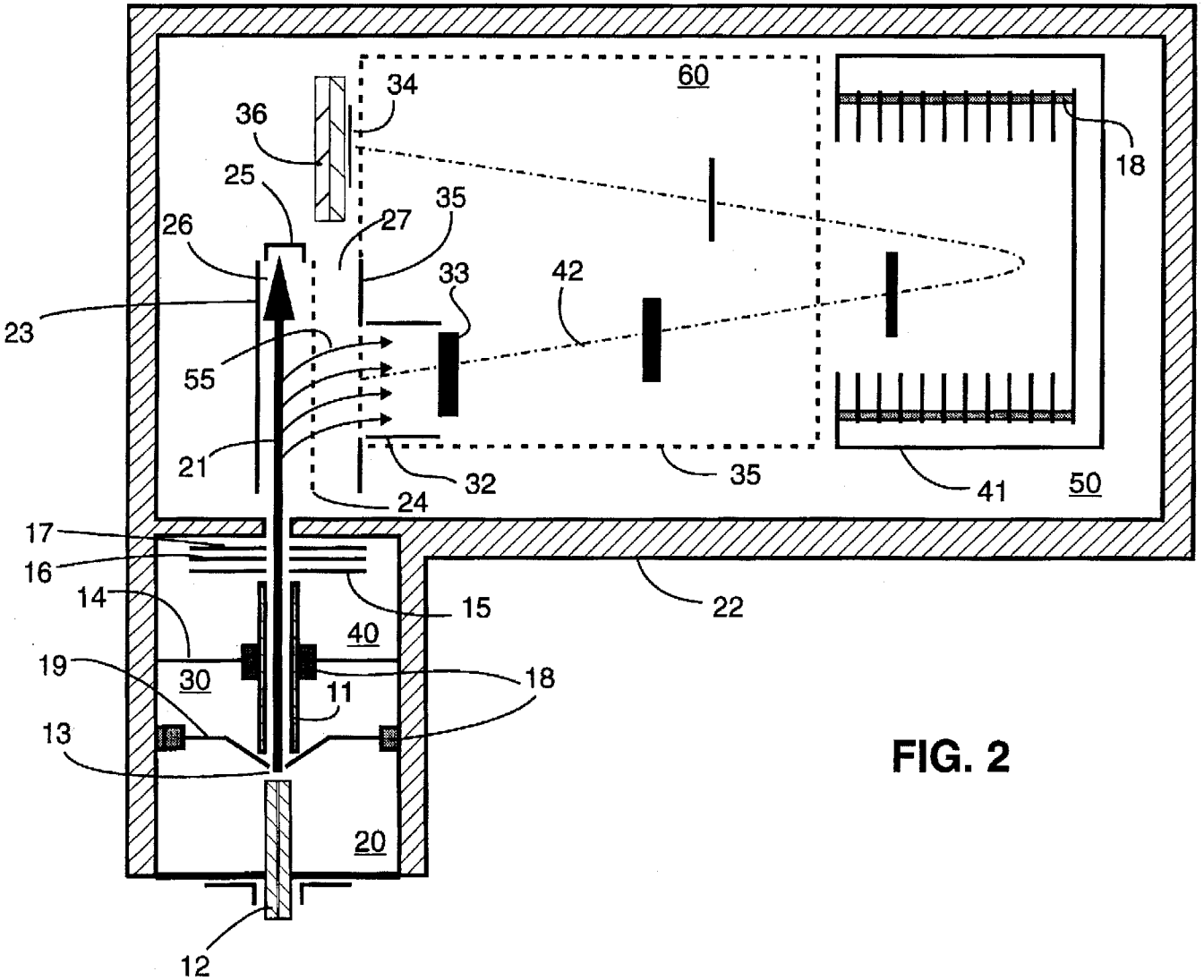
FIG. 2 is a schematic representation of a simple reflectron time-of-flight mass analyzer utilizing orthogonal acceleration with an atmospheric pressure ionization source.
Figure 8:
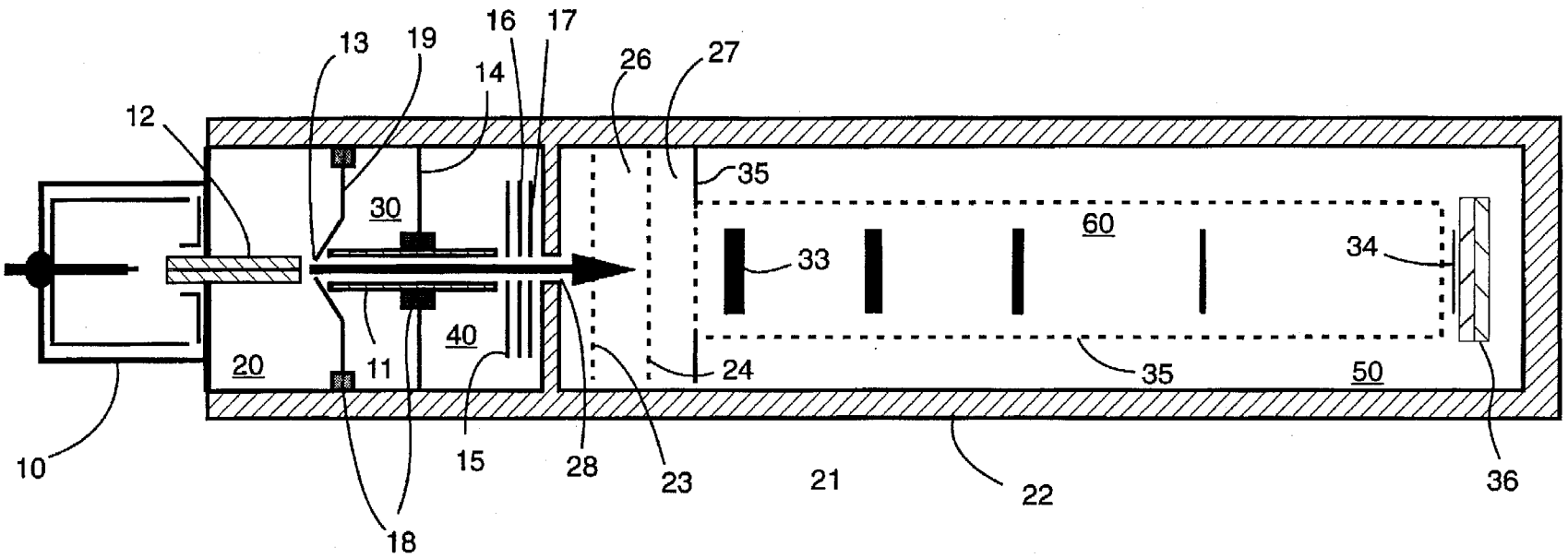
FIG. 8 is a schematic representation of a simple linear time-of-flight mass analyzer utilizing axial acceleration with an atmospheric pressure ionization source.

Among the many atmospheric pressure ionization time-of-flight mass spectrometer configurations covered by prior art, FIG. 1 and FIG. 2 show the two basic time-of-flight instruments used in this study demonstrating the present invention. FIG. 8 also shows an alternative but less frequent configuration used in our studies. The instruments contain an external atmospheric pressure ion source 10 and a means for transporting the ions from the atmospheric pressure ionization source to the mass analyzer all of which are encased by the vacuum housing walls 22. Both the ions and the background gas are introduced into the first stage pumping region 20 by means of a capillary interface 12 and are skimmed by a conical electrostatic lens 19 with a circular aperture 13. The ions are formed into a beam 21 by a multipole ion guide having round rods 11 and are collimated and transferred into the pulsing region 26 of the time-of-flight mass analyzer by transfer ion optic lenses 15, 16, and 17. The multipole ion guide can be a multipole ion guide extending through multiple vacuum pumping stages, according to the preferred embodiment. Multipole ion guides extending through multiple vacuum pumping stages are described in U.S. patent application Ser. Nos. 08/645,826 (filed May 14, 1996) and 08/202,505 (filed Feb. 28, 1994), the disclosures of which are hereby incorporated herein by reference. Alternatively, separate multipole ion guides in separate vacuum pumping stages can be used.

Electrically insulating materials such as spacers 18 are used to isolate the various ion optic lenses throughout the apparatus. Along the path of the transfer ion optics, the gas density is reduced going through four different pumping stages. The skimmer orifice separates the gas flow between the first and the second pumping stages 20 and 30, the ion guide support bracket 14 and the ion guide itself acts as a separator between the pumping stages 30 and 40. A hole 28 in the vacuum housing 22 separates the third pumping stage 40 from the fourth pumping stage 50 where the time-of-flight mass analyzer components reside. The four vacuum stages are pumped conventionally with a combination of turbo and mechanical pumps.

The time-of-flight mass analyzer shown in FIG. 1 and FIG. 2 are said to be operating in an orthogonal injection mode because ions generated outside of the spectrometers are injected perpendicularly to the direction of the accelerating fields 26 and 27 defined by the electrostatic lenses 23, 24, and 35 (See e.g., the O'Halloran et al., Dodonov et al., USSR Patent SU 1681340 references cited below). The ion beam 21 enters the time-of-flight analyzer through an aperture 28 and traverses the first accelerating or the extraction region 26. A Faraday cup 25 is used to monitor and optimize the ion current of the ion beam 21 into the region 26 when the electric field is off, i.e. the voltage on the repeller plate 23 is equal to the voltage on the draw-out plate 24. Typically that would be the ground voltage potential. By applying a pulsed electric field momentarily between the repeller lens 23 and the draw-out lens 24, a group of ions 33 starts to move instantaneously in the direction 55, through the second stage acceleration field set by the plates 24 and 35 and towards the field free drift region 60 surrounded by the flight tube 35. The pulsed electric field generated by the pulsing of the repeller lens 23 establishes the start time for the measurement of the flight time distribution of the ions arriving at the detector 36. The flight time through the apparatus is related to the mass to charge ratios of the ion. Therefore the measurement of the flight time is equivalent to a determination of the ion's m/z value. To offset or adjust the direction of the ion packet 33 to hit the detector 36, set of deflectors 32 may be used after the acceleration region 27 and inside the field free drift region 60. If the deflectors are not used with orthogonal injection, the detector has to be placed off axis at a position to account for the energy of the ions in the direction of the ion beam 21.

The mass resolution of a time-of-flight mass spectrometer is defined as $m/\Delta m = t/2\Delta t$ where m is the ion mass, $\Delta m$ is the width of the ion package arriving at the detector at full width half maximum (FWHM), t is the total flight time of this ion, and $\Delta t$ is the arrival time distribution at the detector measured at FWHM. As a result, higher resolution can be achieved in one of two ways: increase the flight time of ions or decrease the arrival time distribution of the ions at the detector. Given a fixed field free drift length, the latter is achieved in the present mass spectrometer with a two stage accelerator of the type first used by Wiley and McLaren. The electric fields in the two acceleration regions 26 and 27 are adjusted by the voltages applied to the lenses 23, 24, and 35 such that all ions of the same m/z start out as a package of ions 33 with a finite volume defined by the acceleration region 26 and end in a much narrower package 34 when they hit the detector. This is also called the time-space focusing of the ions which compensates for the different initial potential energy of the ions located in different positions in the electric field in region 26 during the pulse. The time-space focusing of the ions does not however compensate for the different energy distribution of the ions along the direction of the acceleration field before the field is turned on. The degree of the energy spread component of the ions in the acceleration axis determines the time distribution of the ions arriving at the detector. The larger the spread of energy of the ions in this direction, the lower will be the mass resolving power of the instrument. The orthogonal injection of the ions does minimize, to some degree, the energy spread of the externally injected ions in the direction of acceleration resulting in a narrower package of ions hitting the detector. To further increase the resolution of the time of flight instrument caused by the energy spread of the ions, a reflectron of the type first used by Mamyrin (cited below) can be used. FIG. 2 shows such an instrument which is the same as in FIG. 1, except a reflectron 41 is added for operating the mass analyzer in a higher resolution and mass accuracy mode.

The coupling of continuously operating ion sources 10 to a time-of-flight mass spectrometer suffers from the inefficient use of the ions created in the ion source for the actual analysis in the mass spectrometer. High repetition rates of the flight time measurements counted by the pulsing of the repeller lens 23 and the extraction of ions from an elongated volume 26 can improve the situation, but effective duty cycles achieved are still of the order of 1 to 50%.

Figure 3:
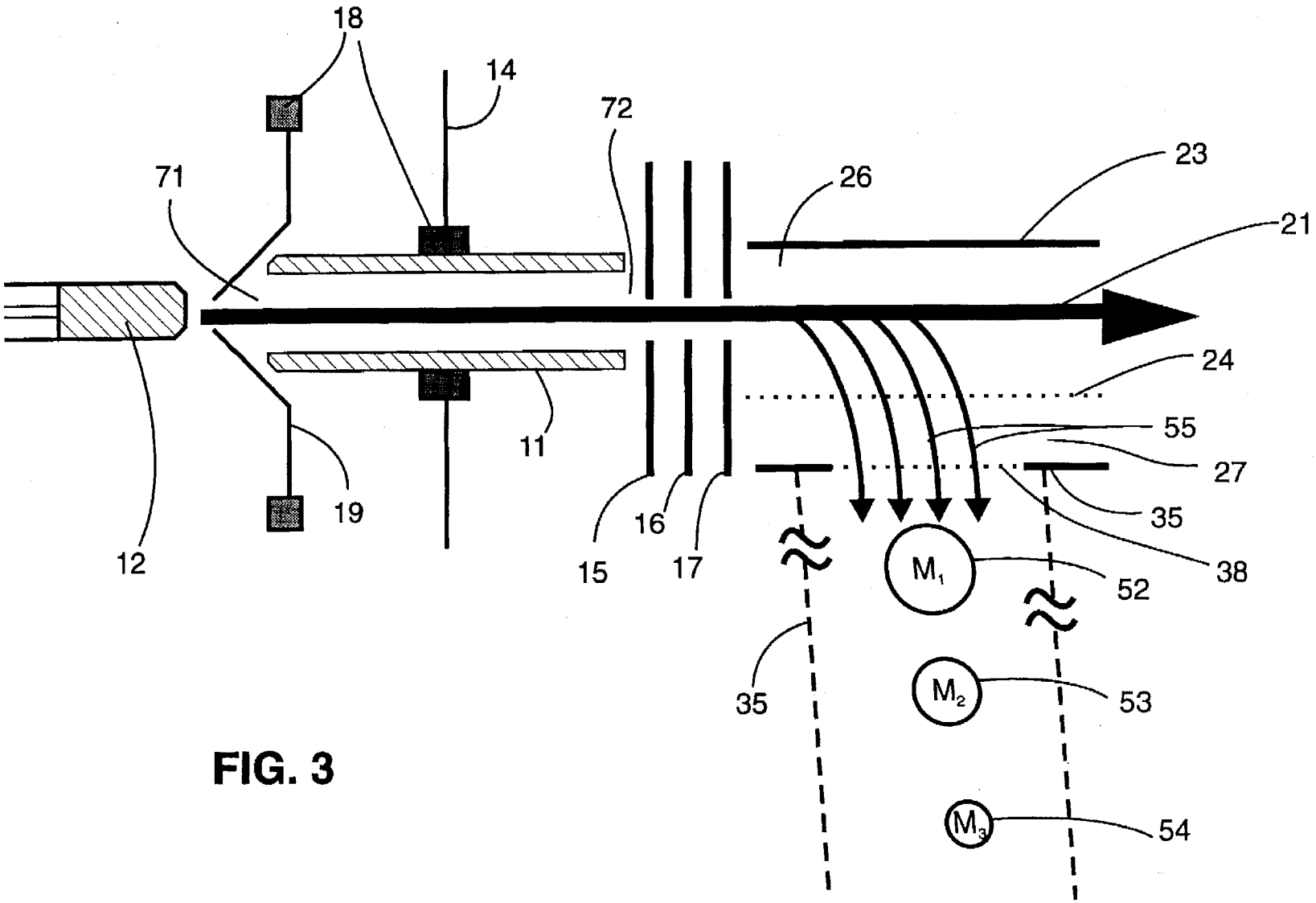
FIG. 3 is a schematic drawing of the interface ion optics between the ion source and the mass analyzer.

To demonstrate the point, consider a continuous beam of ions 21 in FIG. 3 having a mixture of three ions 52, 53, and 54 with molecular weights 997 ($M_1$), 508 ($M_2$), and 118 ($M_3$) entering the pulsing region 26 with electrostatic energy of 10 eV. With these parameters, the approximate velocity of the ions going through the acceleration region 26 at the absence of the field would be 4 mm/μs, 1.9 mm/μs, and 1.4 mm/μs, respectively. If practical experimental parameters, for example, 10,000 repetition rate per second of the repeller lens 26 (a single scan lasting 100 μs) and 20 mm of pulsing region length determined by the mesh size opening 38 on the lens 35, are used, for every one ion of mass $M_1$ 52, $M_2$ 53 and $M_3$ 54, going in the direction 55 of the time-of-flight analyzer detector, seven, ten, and twenty ions will be lost going in the direction 21. The approximate calculated duty cycles for the ions $M_1$ 52, $M_2$ 53, and $M_3$ 54, will result in 14%, 10%, and 5%, respectively.

In order to achieve higher extraction duty cycles with continuous ion beams several parameters can be adjusted. For example, repetition rates of 20,000 Hz or more can be used, the energy of the ions can be lowered, or the extraction region can be extended in the direction of the ion beam 21. However, many of these changes will result in an increase of duty cycles by at best a factor of two before practical limitations can be exceeded. Difficult to build or expensive to buy mass analyzer components such as detectors with larger surface area, faster data acquisition systems etc., will be needed to achieve higher duty cycles.

Figure 4:
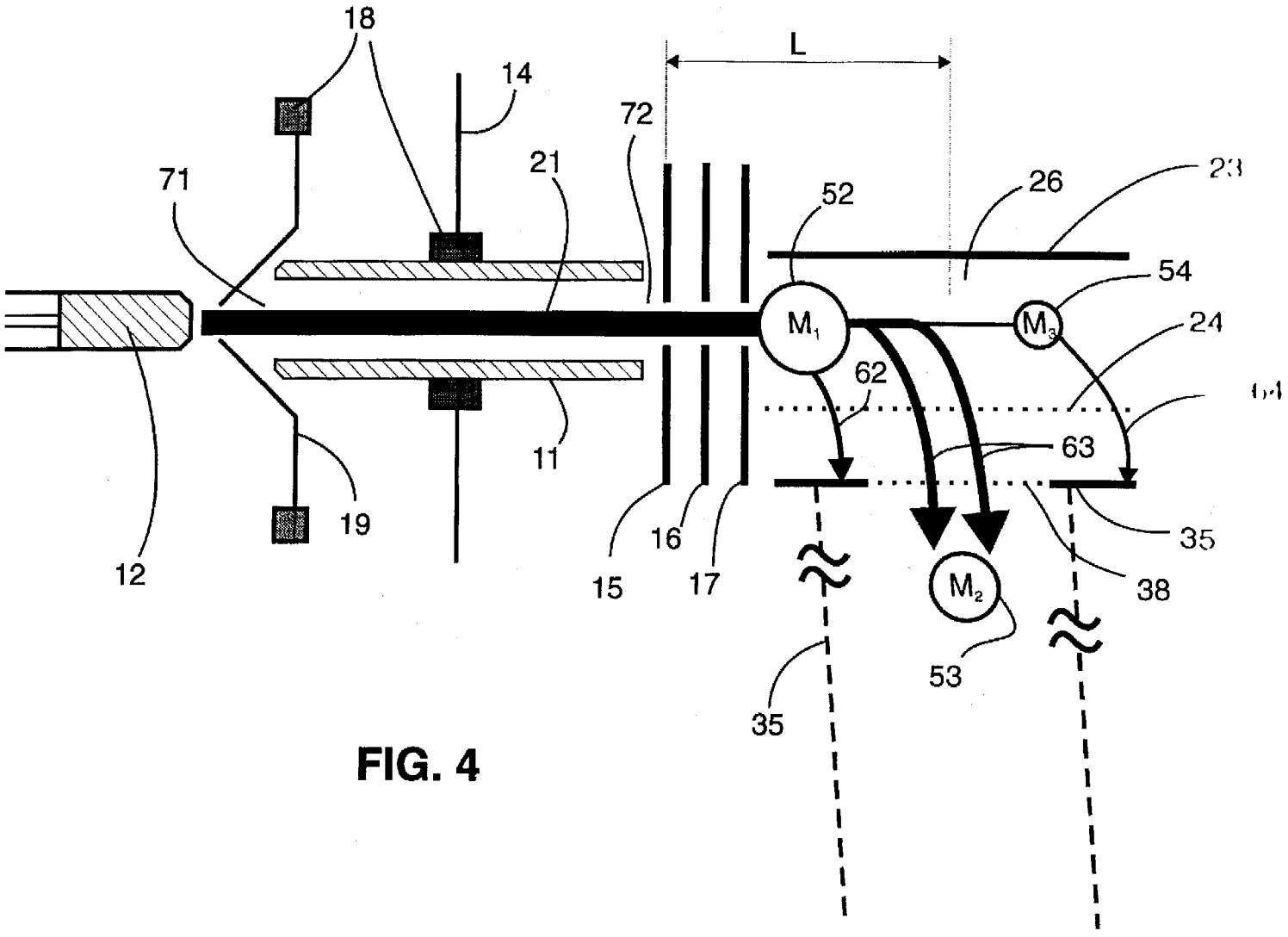
FIG. 4 is a schematic drawing of the interface ion optics between the ion source and the mass analyzer using a two dimensional ion trap.
Figure 5:
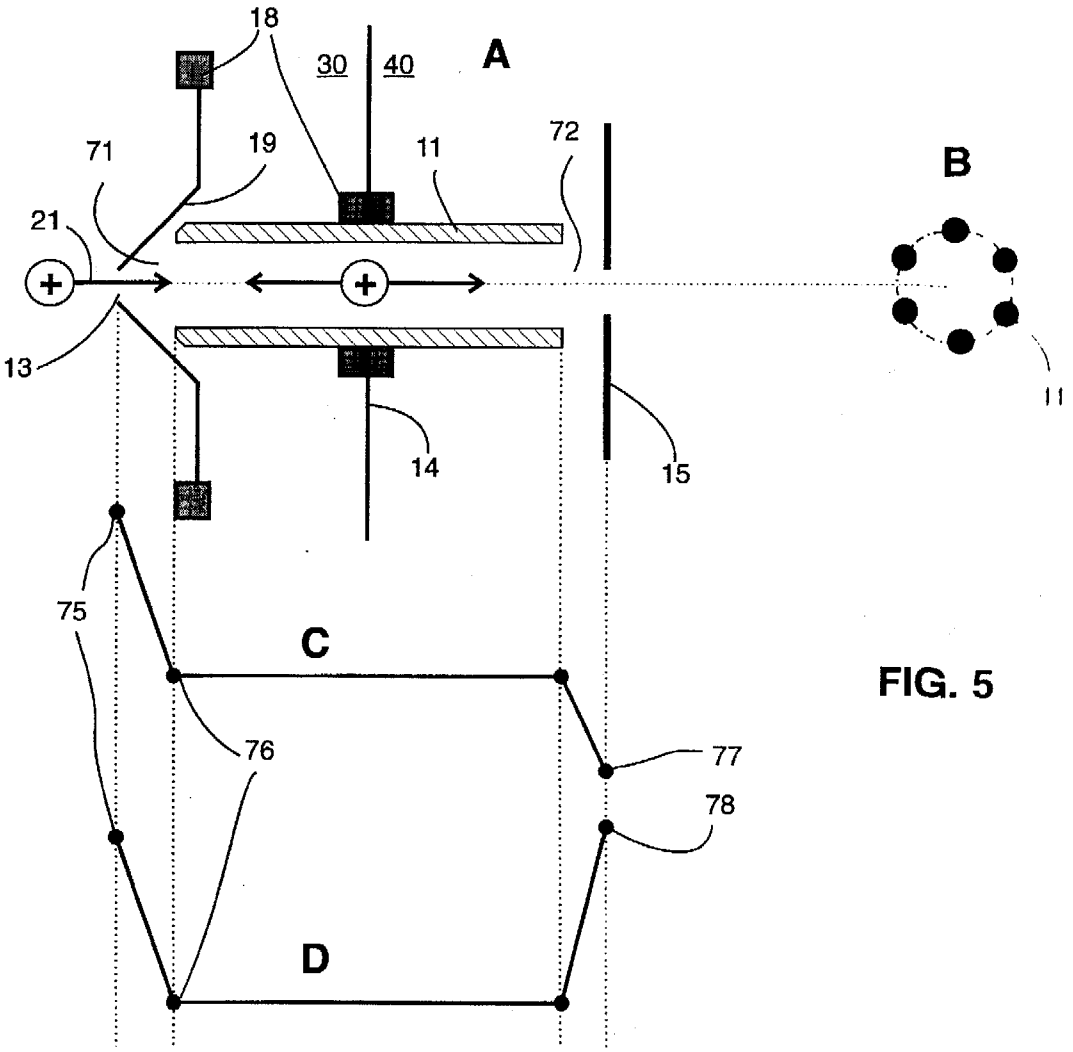
FIG. 5 is the detailed view of the ion guide and the surrounded ion optics (A), cross section of the multipole ion guide with six rods (B), electrostatic voltage levels on the said ion optics when the ions are released (C) and trapped (D).
Figure 6:
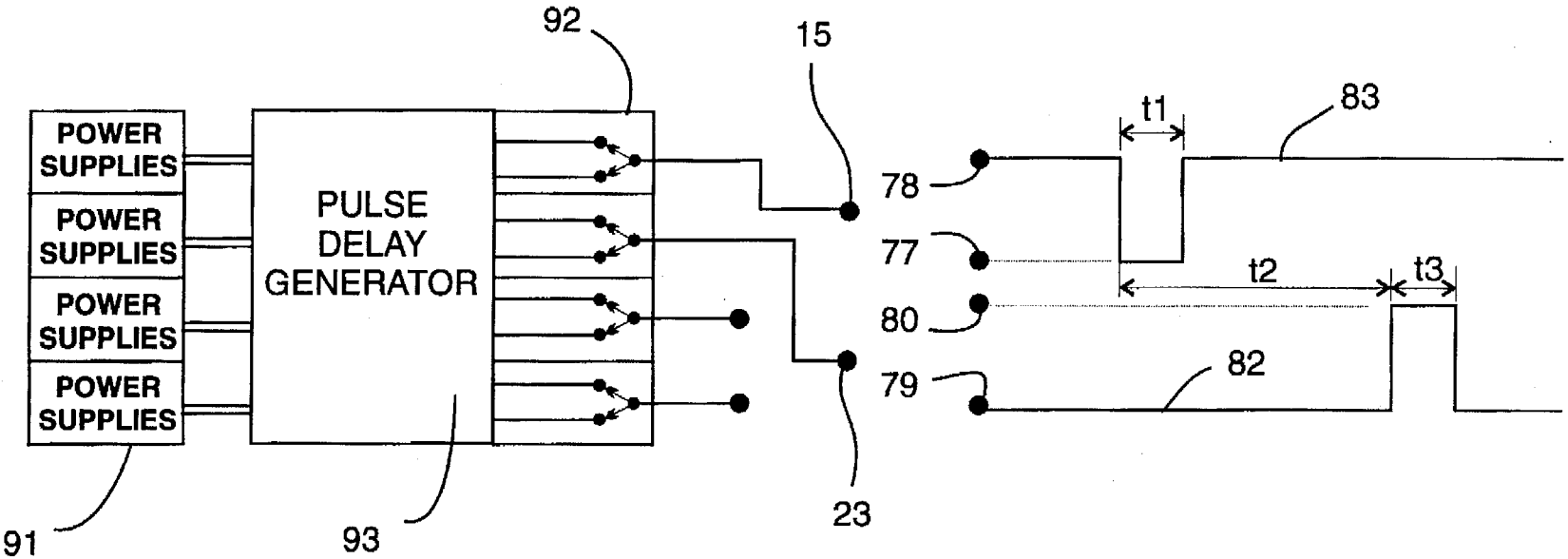
FIG. 6 is the relative timing diagram of the ion guide exit lens and the time-of-flight repeller lens voltages.

To make use of the limited number of ions generated in the ion source 10, some sort of ion storage mechanism in-between the analysis cycles is required. FIG. 3 shows a section of a time-of-flight mass spectrometer that utilizes an existing RF-only multipole ion guide being used in the continuous ion mode of operation. FIG. 4, FIG. 5, and FIG. 6 show the same multipole ion guide being used in the ion storage mode of operation with appropriate power supply and pulse drive and delay generators.

In recent years, the commercial use of such RF-only multipole ion guides have been practiced widely in continuous mode, especially in mass spectrometers interfaced with atmospheric pressure ionization (API) sources. The number of rods used in the multipole ion guide assemblies may vary; the examples in this invention will show predominantly hexapole, meaning six round, equally spaced in a circle, and parallel, set of rods 11 as shown in FIG. 5B. The alternate rods 11 are connected together to an oscillating electrical potential. Such a device is known to confine the trajectories of charged particles in the plane perpendicular to the ion beam axis 21, whereas motion in the axial beam direction is free giving rise to the term, "two dimensional ion trap". Depending on the frequency and amplitude of the oscillating electrical potential, stable confinement can be achieved for a broad range of values of the mass to charge ratio along the beam axis 21. A static bias voltage potential 76 is applied to all the rods to define the mean electrical potential of the multipole with respect to the ion guide entry conical electrode 19 with voltage 75 and with respect to the ion guide exit electrode 15 with voltage value 77 or 78.

As seen in FIG. 5C, in the continuous mode of operation, for a positively charged stream of ions 21 to enter and be focused into the ion guide through a skimmer orifice 13, the voltage value 75 applied to the conical electrode 19 has to be higher than the bias voltage value 76 applied to the ion guide rods 11. By the same token, to push and focus the ions beyond the ion guide, a voltage value 77 even less than the bias voltage value 76 needs to be applied to the ion guide exit lens electrode 15. When the ion guide is operated in the storage mode as seen in FIG. 5D, the voltage value on the exit lens electrode 15 is raised from 77 to 78 which is higher than the ion guide bias voltage 76. This higher voltage value 78 on the lens electrode 15 repels the ions in the exit region 72 of the ion guide back towards the entrance region 71 of the ion guide. As evident from FIG. 5D, the voltage values set in this manner form a potential well in the longitudinal direction of the ion guide efficiently preventing the ions from leaving the ion guide.

A particularly useful feature of the ion guide in regards to this invention is the higher gas pressure in the ion entry region 71 and the region up to the second and third pumping stage partitioning wall 14 inside the ion guide. Due to the expanding background gas jet, this region 30 is under viscous flow pressure regime with gas flowing and becoming less dense in the direction of the ion beam 21. This feature accomplishes two important functions in the time-of-flight instrument. One, due to collisional cooling, it sets a well defined and narrow ion energy of the beam 21. Two, it allows high efficiency trapping of the ions along the ion guide enclosed by the rods 11, the conical lens 19 and the exit lens 15.

Both in the continuous mode of operation and in the storage mode, the final electrostatic energy of the ions entering the time-of-flight analyzer pulsing region 26 is determined by the voltage difference set between the ion guide bias voltage 76 and the time-of-flight repeller plate 23 when the field is off. Due to collisions with the molecules of the dense gas jet in the region 71, the ions do not gain kinetic energy in the electric field but slide gradually down the electric potential well shown in FIG. 5D. In this way, they attain a total energy close to the bias potential 76.

The ion guide rods 11 extend both through the second 30 and third 40 pumping stages without any interruptions; they allow ions to flow freely in the forward and backward directions in the ion guide with close to 100% efficiency. As ions move backwards towards the conical lens 19, the higher gas density moving in the forward direction prevents the ions from hitting the walls of the conical lens. The ions are efficiently brought to thermal equilibrium by these multiple collisions with residual or bath gas molecules while ions from the ion source are constantly filled into the trap through the aperture 13. The higher pressure in the vacuum stage 30 also allows ions to go back and forth multiple times inside the ion guide. As a result, the ion guide exit lens voltage 78 can be adjusted freely not only higher than the bias voltage 76, but also higher than the conical lens voltage 75. If the higher pressure region 71 was absent in the ion guide, a voltage setting 78 higher than 75 would have crashed the ions into the conical lens 19 after a single pass. Without the higher pressure region 71, the voltage settings 75, 76 and 78 would be more critical and difficult to set with respect to each other for efficient trapping of the ions in the ion guide.

As the voltage on the exit lens 15 is switched from level 78 to 77 for a short duration (of the order of microseconds), high density ion bunches are extracted collision free from the low pressure storage region 72 and injected into the orthogonal time-of flight analyzer. The mechanism for the storage mode of operation can be seen in FIG. 4. The ions are subsequently accelerated by means of additional electrodes 16 and 17. These electrodes in the present system are held at constant potentials, but they can be switched synchronously to the switching of the lens 15. After being pulsed out of the region 72, all ions of the packet originally extracted will have in first order approximation the same final kinetic energy $qU_0$, where $U_0$ is the total accelerating potential difference between the ion guide bias voltage 76 and the time-of-flight repeller lens voltage when the field is off in the pulsing region 26. Then, ions of a specific mass to charge ratio will have a final velocity which is proportional to the reciprocal square root of this ratio:

$$v_0 = k_1 \cdot \sqrt{\frac{2 \cdot q \cdot U_0}{m}} \tag{1}$$

Here, $k_1$ is a constant, q=ze is the charge of the ion, and m is its mass. Ions will travel a distance L to arrive at the same point in the pulsing region 26 after a certain time T shown by $$T_m = k_2 \cdot \frac{L}{v_0} \tag{2}$$

$k_2$ is a constant that takes into account the ion acceleration process. Hence, ions with a different m/z ratio will pass a point in region 26.

$$T_1 - T_2 = \frac{k_2 \cdot L}{k_1 \cdot \sqrt{2 \cdot e \cdot U_0}} \left[ \sqrt{\frac{m_1}{z_1}} - \sqrt{\frac{m_2}{z_2}} \right] \tag{3}$$

Accordingly, the initial ion package is spread out in space along the region 26 in the direction of the ion beam.

FIG. 6 shows the driving mechanism and the timing sequence between the ion guide exit lens 15 and the time-of-flight repeller lens 23 for a single cycle, i.e. a single mass spectral scan. The trace 83 shows the ion guide exit lens voltage status switching between the two voltage levels 77 and 78 and the trace 82 shows the repeller lens voltage status switching between the two levels 79 and 80. The power supply 91 sets the desired upper and lower voltage levels to be delivered to the lenses at all times. The electrically isolated fast switching circuitry 92 controls synchronously the desired voltage levels of the lens electrode 15 and the repeller plate 23 to be switched back and forth during the designated time intervals controlled by the pulse and delay generating device 93, which is an accurate timing device, which in turn is controlled by the user interface.

As an example to the ion storage mode of operation, let us again use the same mixture of ions $M_1$, $M_2$, and $M_3$ of ionic masses 997, 508 and 118 as used above in continuous mode of operation. As shown in FIG. 4, and FIG. 6 the pulsed ion beam of duration t1 from the region 72 is injected between the parallel plates 23 and 24 when the plates are initially held at the absence of an electric field, i.e. voltage level 79 on the repeller lens 23. According to the above equation (3), lighter ions moving faster than the heavier ions, the three masses will start to separate from each other in the region 26. After a certain variable delay t2, the electric field in the region 26 is pulsed on for a short period of time t3 by the repeller plate 23. The delay time t2 can be changed to allow different sections of the original ion beam, i.e. different m/z packages, to accelerate perpendicular to their original direction towards the flight tube 35 to be detected for mass analysis. In this example, a delay time t2 was chosen to pulse only a narrow range of ions centered around mass ($M_2$) 53 which were accelerated in the direction 63 at the instant the field was turned on. At the same instant, both the masses $M_1$ 52 and $M_3$ 54 will hit the sides of the lenses moving in the approximate direction 62 and 64 and will not be detected by the mass analyzer.

The range of the detectable m/z window around a certain mass can be adjusted with several parameters. For a fixed exit lens pulse width t1 and a delay time t2, the width of the mesh aperture 38 and the detector 36, for example, determines the m/z packet size along the direction 21 that is allowed to pass. The wider the aperture size on the mesh 38 and the detector 36, the larger will be the detected mass range. In addition, the pulse width t1 of the lens 15 can be kept longer to sample a wider mass range of ions coming from the part of the ion guide that is further inside and away from the exit lens 15. As the pulse width t1 of the lens 15 is kept longer, multiple time-of-flight ejection pulses are possible for one ion trap extraction cycle approaching the continuous mode of operation.

Figure 7A:
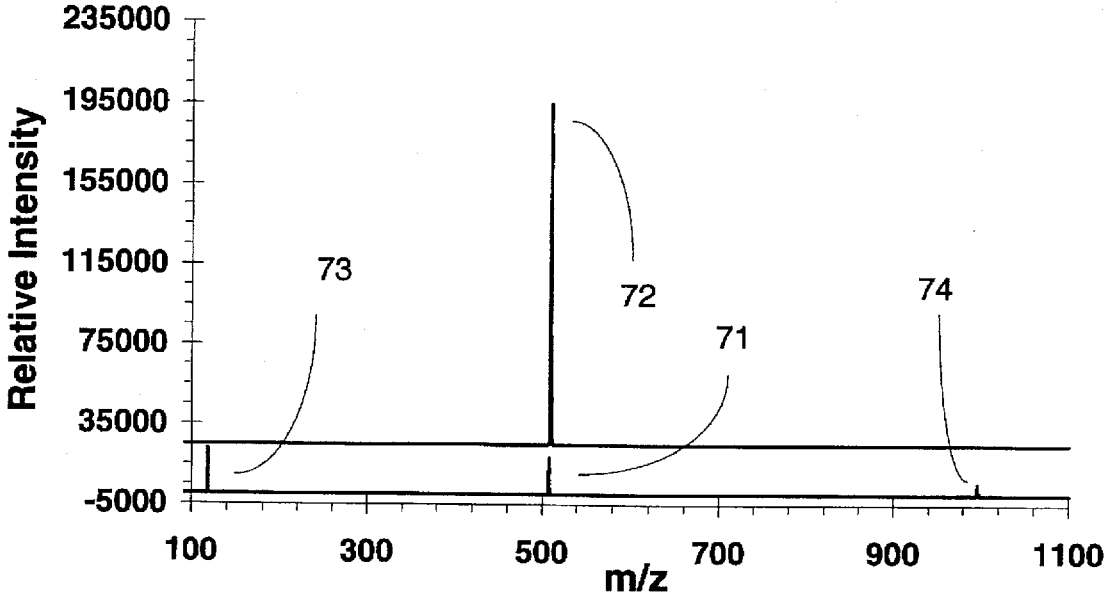
FIGS. 7A and 7B are the time-of-flight mass spectral comparison between the continuous and ion storage mode of operations.
Figure 7B:
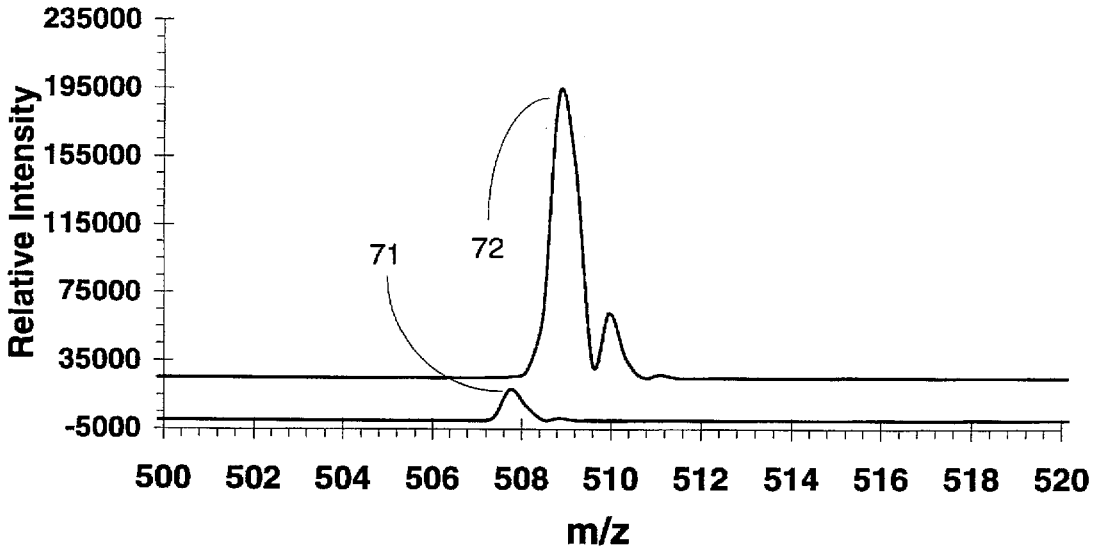

FIGS. 7A and 7B show the actual experimental results acquired using both the continuous and ion storage mode of operations for a sample using a mixture of ions used in the above examples. The actual sample was a mixture of three compounds Valine, tri-tyrosine, and hexa-tyrosine. Upon electrospray ionization of this mixture, the predominant molecular ions with nominal masses 118, 508, and 997 are generated in the ionization source 10. The bottom trace of FIG. 7A shows all three of these ions detected and registered as peaks 73, 71, and 74 when the mass spectrometer was in the continuous mode of operation. The top trace mass spectrum in FIG. 7A shows the results when the mass spectrometer was changed to the ion storage mode of operation. Both modes were acquired in similar experimental conditions. The acquisition rate i.e. the repetition rate counted by the repeller lens was 8200 per second. Each trace represents 4100 full averaged scans. As seen from the top spectral trace, there is only one predominant registered peak 72 in the spectrum. This peak corresponds to a molecular ion 508 enhanced in signal strength by about a factor often with respect to the peak 71 in continuous mode of operation. For the reasons explained in above examples, both of the molecular ions 118 and 997 are absent from the ion storage mode spectral trace as expected. The signal intensity increase comes from the fact that all of the ions that would otherwise be lost in the continuous ion mode were actually being stored in the ion guide for the next scan. According to the above example, for the continuous mode of operation, the approximate duty cycle calculated for the 508 peak at 8,200 scans/s would be 9% i.e. one out of every twelve ions being detected. As the experimental results suggest in the ion storage mode of operation at 8,200 scans/s in FIG. 7A, most of the lost ions predicted in the continuous ion mode were recovered. FIG. 7B shows the same spectral traces, except the m/z region is expanded between 500 and 520 to show the isotopic peaks in more detail. The slight shift between the peaks 71 and 72 are due to the different tuning conditions of the ions by the lenses 16 and 17 that lands the ions in different position in the acceleration region 26. These differences resulted in the slight arrival time shifts of the ions on the detector resulting in different mass assignments.

Consequently, in summary and conclusion, an improved apparatus for analyzing ionic species using a time-of flight mass analyzer is provided herein. In the preferred embodiment, the apparatus, has an atmospheric pressure ionization source which produces ions for transmission to a time-of-flight mass analyzer. The apparatus has a two dimensional ion guide enhancing the efficiency of transmission of the ions, operating between the atmospheric pressure ion source and the time-of-flight mass analyzer, the ion guide having a set of equally spaced, parallel, multipole rods and operating in the RF-only mode of operation, having an ion entrance section where the ions enter said ion guide and an ion exit section where the ions exit the ion guide, and having an ion entrance lens placed at the ion entrance section and an ion exit lens at the ion exit section. The ion guide is positioned such that the ion entrance section of the ion guide is placed in a region where background gas pressure is at viscous flow, and such that the pressure along the ion guide at the ion exit section drops to molecular flow pressure regimes without a break in the structure of the ion guide. The ion guide is operated in the ion storage mode using a fast voltage switching device to switch voltage levels of the ion guide exit lens. The apparatus further has a time of flight acceleration region the ions are pulsed out momentarily to be mass analyzed, with the ions being injected into the time-of-flight acceleration region in a direction orthogonal to the direction of the acceleration field of the time-of-flight acceleration region. A detector is also provided where the ions are mass analyzed according to their arrival times, and an accurate timing device is provided that synchronizes the voltage switching device, and which determines the respective voltage levels and the duration of the voltage levels of the ion guide exit lens and the time-of-flight acceleration field to each other.

Although the invention has been described in terms of specific preferred embodiments, it will be obvious and understood to one of ordinary skill in the art that various modifications and substitutions are contemplated by the invention disclosed herein and that all such modifications and substitutions are included within the scope of the invention as defined in the appended claims.

REFERENCES CITED

The following references referred to above are hereby incorporated herein by reference:

U.S. Patent Documents

U.S. Pat. No. 5,179,278 Jan. 12, 1993 D. J. Douglas

U.S. Pat. No. 2,685,035 Jul. 27, 1954 W. C. Wiley

Foreign Patent Documents

SU 1681340 A1 Feb. 25, 1987 USSR Patent Dodonov et al.

Other References Cited

C. Beaugrand and G. Devant, Ion Kinetic Energy Measurement on Tandem Quadrupole Mass Spectrometers, 35th ASMS Conference on Mass Spectrometry and Allied Topics, Denver, Colo. (1987).

J. G. Boyle, C. M. Whitehouse, J. B. Fenn, Rapid Commun. Mass Spectrom. 5, 400 (1991).

B. M. Chien, S. M Michael, D. Lubman, Int. J. Mass Spect. Ion Proc. 131, 149 (1994).

J. H. J. Dawson, M. Guilhaus, Rapid Commun. Mass Spectrom. 3, 155 (1989).

A. F. Dodonov, I. V. Chernushevich, V. V. Laiko, 12$^{th}$ Int. Mass Spectr. Conference, Amsterdam (1991).

G. G Dolnikowski, M. J. Kristo, C. G. Enke, and J. T. Dawson, Intl. Jour. of Mass Spec. Ion Proc., 82, p. 1–15, (1988), Ion Trapping Technique for Ion/Molecule Reaction Studies in the Center Quadrupole of a Triple Quadrupole Mass Spectrometer.

R. Grix, U. Gruner, G. Li, H. Stroh, H. Wollnik, Int J. Mass Spect. Ion Proc. 93,323 (1989).

R. F. Herzog, Z. Phys. 89 (1934), 97 (1935); Z. Naturforsch 8a, 191 (1953), 10a, 887 (1955).

V. I. Karataev, B. A. Mamyrin, D. V. Shmikk, Sov. Phys. Tech. Phys. 16, 1177 (1972).

V. V. Laiko and A. F. Dodonov, Rapid Commun. Mass Spectrom. 8, 720 (1994).

B. A. Mamyrin, V. I. Karataev, D. V. Shmikk, V. A. Zagulin, Sov. Phys. JETP37, 45 (1973).

S. M. Michael, M. Chien, D. M. Lubman, Rev. Sci. Instrum. 63 (10), 4277 (1992).

O. A. Migorodskaya, A. A. Shevchenko, I. V. Chernushevich, A. F. Dodonov, A. I. Miroshnikov, Anal. Chem. 66, 99 (1994).

A. V. Mordehaj, G. Hopfgartner, T. G. Huggins, J. D. Henion, Rapid Commun. Mass Spectrom. 6, 508(1992).

A. Mordehai, J. Karnicky, B. Limbek, and S. E. Buttrill, Jr., "A New LC Electrospray Ion Trap Time-Of Flight Mass Spectrometer", 43rd ASMS Conference on Mass Spectrometry and Allied Topics, Atlanta, Ga. (1995).

G. J. O'Halloran, R. A. Fluegge, J. F. Betts, W. L. Everett, Report No. ASD-TDR 62-644, Prepared under Contract AF 33(616)-8374 by The Bendix Corporation Research Laboratories Division, Southfield, Mich. (1964).

A. N. Verentchikov, W. Ens, K. G. Standing, Anal. Chem. 66, 126 (1994).

W. C. Wiley, I. H. McLaren, Rev. Sci. Inst. 26, 1150 (1955).

What is claimed is:

1. An apparatus for analyzing ionic species using a time-of-flight mass analyzer comprising:

an atmospheric pressure ionization source which produces ions for transmission to a time-of-flight mass analyzer;

a two dimensional ion guide for enhancing the transmission efficiency of said ions, said ion guide operating between said atmospheric pressure ion source and said time-of-flight mass analyzer, said ion guide having a set of equally spaced, parallel, multipole rods and operating in the RF-only mode of operation, said ion guide having an ion entrance section where said ions enter said ion guide and an ion exit section where said ions exit said ion guide, and having an ion entrance lens placed at said ion entrance section and an ion exit lens placed at said ion exit section, said ion guide being positioned such that said ion entrance section is placed in a region where background gas pressure is at viscous flow, and such that the pressure along said ion guide at said ion exit section drops to molecular flow pressure regimes without a break in the structure of said ion guide, said ion guide being operated in the ion storage mode using a fast voltage switching device to switch voltage levels of said ion guide exit lens;

a time of flight acceleration region where said ions are pulsed out momentarily to be mass analyzed, said ions being pulsed in said time of right acceleration region by an acceleration field and being injected into said acceleration region orthogonal to the direction of said acceleration field;

a detector where said ions are mass analyzed according to their arrival times; and, an accurate timing device that controls said voltage switching device for synchronizing said voltage levels of said ion guide exit lens and voltage levels of a time-of-flight acceleration electrode, and which determines the respective voltage levels and the duration of said voltage levels of said ion guide exit lens and said time-of-flight acceleration field to each other.

2. The apparatus according to claim 1, wherein said mass analyzer contains a reflectron to compensate for energy distribution of said ions in said acceleration region.

3. The apparatus according to claim 1, wherein said two dimensional ion guide is in the direction perpendicular to said acceleration field.

4. The apparatus according to claim 1, wherein said multipole ion guide has at least four rods.

5. The apparatus according to claim 1, wherein said ions are injected axially into said acceleration field of said time-of-flight mass analyzer.

6. A method for analyzing ionic species using a time-of-flight mass analyzer, comprising the steps of:

using an atmospheric pressure ionization source to produce ions for transmission to a time-of-flight mass analyzer;

enhancing the efficiency of transmission of said ions from said ion source to said time-of-flight mass analyzer using a two dimensional ion guide operating between said ion source and said time-of-flight mass analyzer;

operating said ion guide in the RF-only mode of operation, said ion guide having a set of equally spaced, parallel, multipole rods, and having an ion entrance section and an ion exit section;

placing an ion guide entrance lens at said ion entrance section where said ions enter said ion guide, and an ion guide exit lens at said ion exit section where said ions exit said ion guide;

positioning said ion guide such that said ion entrance section is located in a region where background gas pressure is at viscous flow, and such that the pressure along said ion guide at said ion exit section drops to molecular flow pressure regimes without a break in the structure of said ion guide;

operating said ion guide in the ion storage mode using a fast voltage switching device, to switch voltage levels of said ion guide exit lens between levels that empty and trap said ions;

injecting said ions in the orthogonal direction into a time-of-flight acceleration field where said ions are to be mass analyzed by switching on an electric field in a time-of-flight acceleration region after a time delay of the appropriate voltage level of said ion guide exit lens is switched to empty said ions;

detecting said ions according to their arrival times at the end of said time-of-flight mass analyzer;

storing said ions which enter continuously into said ion guide during said mass analysis operation by switching the voltage level of said ion guide exit lens to a level to trap said ions along said ion guide between said ion guide entrance lens and said ion guide exit lens; and, using an accurate timing device to control the switching device for synchronizing said voltage levels of said ion guide exit lens and voltage levels of a time-of-flight acceleration electrode, and to determine the respective voltage levels and the duration of said respective voltage levels of said ion guide exit lens and the time-of-flight acceleration field.

7. The method for analyzing ionic species using a time-of-flight mass analyzer according to claim 6, wherein said mass analyzer contains a reflectron to compensate for energy distribution of said ions which are in said acceleration region.

8. The method for analyzing ionic species using a time-of-flight mass analyzer according to claim 6, wherein said two dimensional ion guide is in the direction perpendicular to said acceleration field.

9. The method for analyzing ionic species using a time-of-flight mass analyzer according to claim 6, wherein said multipole ion guide has at least four rods.

10. The method for analyzing ionic species using a time-of-flight mass analyzer according to claim 6, wherein said ions are injected axially into said acceleration field of said time-of-flight mass analyzer.

* * * * *